US011282694B2

(12) United States Patent
Hasegawa

(10) Patent No.: US 11,282,694 B2
(45) Date of Patent: Mar. 22, 2022

(54) FLASH LAMP AND MANUFACTURING METHOD FOR FLASH LAMP

(71) Applicant: HAMAMATSU PHOTONICS K.K., Hamamatsu (JP)

(72) Inventor: Yusuke Hasegawa, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/284,718

(22) PCT Filed: Aug. 8, 2019

(86) PCT No.: PCT/JP2019/031488

§ 371 (c)(1),
(2) Date: Apr. 12, 2021

(87) PCT Pub. No.: WO2020/079930

PCT Pub. Date: Apr. 23, 2020

(65) Prior Publication Data

US 2021/0358735 A1 Nov. 18, 2021

(30) Foreign Application Priority Data

Oct. 17, 2018 (JP) ..... JP2018-195650

(51) Int. Cl.
*H01J 61/90* (2006.01)
*H01J 61/073* (2006.01)
*H01J 61/30* (2006.01)

(52) U.S. Cl.
CPC ..... *H01J 61/90* (2013.01); *H01J 61/073* (2013.01); *H01J 61/30* (2013.01)

(58) Field of Classification Search
CPC ..... H01J 61/073; H01J 61/30; H01J 61/90
(Continued)

(56) References Cited

U.S. PATENT DOCUMENTS

2015/0249003 A1* 9/2015 Kase ..... H01J 61/86
362/263

FOREIGN PATENT DOCUMENTS

JP S60-151949 A 8/1985
JP S62-281250 A 12/1987
(Continued)

OTHER PUBLICATIONS

International Preliminary Report on Patentability dated Apr. 29, 2021 for PCT/JP2019/031488.

*Primary Examiner* — Christopher M Raabe
(74) *Attorney, Agent, or Firm* — Faegre Drinker Biddle & Reath LLP

(57) ABSTRACT

A flash lamp includes a bulb including a stein, conductive linear members extending to penetrate the stein, and a trigger probe having a discharging portion configured to control discharge, wherein the conductive linear member has a lead pin and an anode protruding toward the conductive linear member on a tip end side of the conductive linear member with respect to the lead pin, wherein the lead pin and the anode are integrally formed members, wherein the conductive linear member has a lead pin and a cathode protruding toward the conductive linear member on a tip end side of the conductive linear member with respect to the lead pin, wherein the lead pin and the cathode are integrally formed members, and wherein the discharging portion of the trigger probe is disposed between the anode and the cathode.

10 Claims, 10 Drawing Sheets

(58) Field of Classification Search
USPC ..... 313/631
See application file for complete search history.

(56) References Cited

FOREIGN PATENT DOCUMENTS

| | | | |
|---|---|---|---|
| JP | S63-099667 | A | 4/1988 |
| JP | H4-126348 | A | 4/1992 |
| JP | H04-054142 | U | 5/1992 |
| JP | 2001-332217 | A | 11/2001 |
| JP | 3465750 | B2 | 11/2003 |
| JP | 2005-527935 | A | 9/2005 |
| JP | 2006-302575 | A | 11/2006 |
| JP | 2012-248353 | A | 12/2012 |
| JP | 2017-004940 | A | 1/2017 |
| WO | WO-03/030212 | A1 | 4/2003 |

* cited by examiner

FLASH LAMP AND MANUFACTURING METHOD FOR FLASH LAMP

TECHNICAL FIELD

An aspect of the present invention relates to a flash lamp and a manufacturing method for a flash lamp.

BACKGROUND ART

A flash lamp that generates a large amount of pulsed light by instantaneously discharging electric power stored in a capacitor is known (see, for example, Patent Literature 1). In the flash lamp described in Patent Literature 1, an electrode portion for discharge is fixed to a tip end of a lead pin extending to penetrate a stein.

CITATION LIST

Patent Literature

[Patent Literature 1] Japanese Unexamined Patent Publication No. 2017-4940

SUMMARY OF INVENTION

Technical Problem

In a case in which the flash lamp as described above is manufactured, a process of fixing the electrode portion to the tip end of the lead pin is required. To manufacture a flash lamp having uniform light emission characteristics, it is important to dispose (to position) the electrode portions uniformly in the lamp, and in addition to fixing accuracy of the lead pin to the stein, fixing accuracy of the electrode portion to the tip end of the lead pin is also required. Therefore, it has been difficult to easily manufacture a flash lamp having uniform light emission characteristics.

An aspect of the present invention has been made in view of the above circumstances, and an object of the present invention is to easily manufacture a flash lamp having uniform light emission characteristics.

Solution to Problem

A flash lamp according to an aspect of the present invention includes a housing including a stem; first and second conductive linear members extending to penetrate the stein; and a trigger probe having a discharging portion configured to control discharge, wherein the first conductive linear member has a first lead portion and an anode portion protruding toward the second conductive linear member on a tip end side of the first conductive linear member with respect to the first lead portion and housed in the housing, wherein the first lead portion and the anode portion are integrally formed members, wherein the second conductive linear member has a second lead portion and a cathode portion protruding toward the first conductive linear member on a tip end side of the second conductive linear member with respect to the second lead portion and housed in the housing, wherein the second lead portion and the cathode portion are integrally formed members, and wherein the discharging portion of the trigger probe is disposed between the anode portion and the cathode portion.

In the flash lamp according to the aspect of the present invention, the first lead portion and the anode portion of the first conductive linear member are integrally formed members, and the second lead portion and the cathode portion of the second conductive linear member are integrally formed members. Accordingly, it is unnecessary to fix the anode portion and the cathode portion (electrode portions) to the first lead portion and the second lead portion. Therefore, by simply fixing (installing) the first and second conductive linear members to the stein appropriately, it is possible to complete the positioning of the anode portion and the cathode portion in the lamp with high accuracy. Therefore, it is possible to easily manufacture a flash lamp having uniform light emission characteristics.

In the above flash lamp, the anode portion may have a larger diameter than the first lead portion, and the cathode portion may have a larger diameter than the second lead portion. By increasing the diameters of the anode portion and the cathode portion, it is possible to cause the discharge between the first and second conductive linear members to be reliably performed between the anode portion and the cathode portion. Accordingly, more uniform light emission characteristics can be obtained.

In the above flash lamp, the anode portion and the cathode portion may be formed in a spherical shape. By forming the anode portion and the cathode portion in a spherical shape, it is possible for the anode portion and the cathode portion to face each other in a desired state regardless of the protruding orientations of the anode portion and the cathode portion when the first and second conductive linear members are fixed to the stein, and it is possible to more easily manufacture a flash lamp having uniform light emission characteristics.

In the above flash lamp, the trigger probe may be made of a straight third conductive linear member extending to penetrate the stein between the first and second conductive linear members. Accordingly, it is easy to accurately dispose the discharging portion of the trigger probe between the anode portion and the cathode portion.

In the above flash lamp, the housing may include a face plate which is a light emitting window provided to face the stein, and the anode portion and the cathode portion may be disposed such that a separation distance from the stein is shorter than a separation distance from the face plate. In this way, by providing the anode portion and the cathode portion at positions closer to the stein, it is possible to reduce a region exposed in a space between the stein and the face plate in the first and second lead portions supporting the anode portion and the cathode portion (a region exposed to a space inside the housing). Accordingly, the discharge between the first and second conductive linear members can be reliably performed between the anode portion and the cathode portion. Therefore, more uniform light emission characteristics can be obtained.

In the above flash lamp, in a space between the face plate and the stein, a surface area of the anode portion may be larger than a surface area of the first lead portion, and a surface area of the cathode portion may be larger than a surface area of the second lead portion. Accordingly, the region occupied by the anode portion and the cathode portion of the first and second conductive linear members exposed in the space between the stein and the face plate (the space inside the housing) can be larger than the region occupied by the first and second lead portions, and the discharge between the first and second conductive linear members can be reliably performed between the anode portion and the cathode portion. Accordingly, more uniform light emission characteristics can be obtained.

In the above flash lamp, the housing may include a face plate which is a light emitting window provided to face the stein, and a thickness of the stein may be thicker than a thickness of the face plate. Accordingly, the first and second conductive linear members penetrating the stein can be easily fixed to the stein while the light transmission of the face plate is improved, and the positional accuracy of the anode portion and the cathode portion can be improved.

The above flash lamp may further include an exhaust tube for exhausting an inside of the housing, wherein the exhaust tube may extend to penetrate the stein, and wherein, when seen in a thickness direction of the stein, the exhaust tube may be provided in a region opposite to the first and second conductive linear members with respect to a center of the stein. In this way, by providing the exhaust tube in the region opposite to the first and second conductive linear members with respect to the center of the stein, it is possible to increase the opening area of the exhaust tube, and it is possible to efficiently exhaust the inside of the housing. Accordingly, the flash lamp can be efficiently manufactured.

A manufacturing method for the flash lamp may include a first process of fixing the first and second conductive linear members to the stein constituting the housing and connected to a side tube provided to surround the anode portion and the cathode portion; and a second process of connecting the face plate which is a light emitting window provided to face the stein to the side tube after the first process. According to such a manufacturing method, the conductive linear member can be fixed to the stein before the face plate or the like is provided. Therefore, the face plate can be fixed in a state in which the anode portion and the cathode portion are surrounded by the side tube, and thus a problem of the face plate coining into contact with the anode portion and the cathode portion during the fixing work of the face plate can be suppressed.

In the first process of the above manufacturing method, the fixing of the first and second conductive linear members to the stein and the connection of the stein to the side tube may be collectively performed. For example, in a case in which the side tube is connected to the stein after the first and second conductive linear members are fixed to the stein, when the side tube is connected to the stein, the positions of the first and second conductive linear members (the fixed state of the first and second conductive linear members) in the stein may be affected. In this respect, by collectively perform the fixing of the first and second conductive linear members to the stein and the connection of the stein to the side tube, it is possible to suppress the influence on the positions of the conductive linear members as described above. Such a batch connection is possible because the lead portion and the anode portion as well as the lead portion and the cathode portion are integrally formed members and are easy to handle as in the aspect of the present invention.

In the first process of the above manufacturing method, the first and second conductive linear members may be fixed to the stein integrally formed with the side tube in advance. That is, by creating the shape in which the stein and the side tube are connected to each other from the beginning, it is possible to suppress the influence of the connection process between the stein and the side tube on the positions of the conductive linear members.

In the first process of the above manufacturing method, in a state in which the side tube and the stein are disposed with respect to a jig having a projection for a through hole of the side tube to be fitted onto with the stein facing the projection, the first and second conductive linear members may be fixed to the stein. In this way, the side tube is fitted and fixed (positioned) to the projection, and the first process is performed, and thus the first process can be performed more easily and with high accuracy.

Advantageous Effects of Invention

According to the aspect, it is possible to easily manufacture a flash lamp having uniform light emission characteristics.

DESCRIPTION OF EMBODIMENTS

Hereinafter, an embodiment of the present invention will be described in detail with reference to the drawings. In each figure, the same or corresponding parts are designated by the same reference signs, and duplicate description will be omitted.

Figure 1:
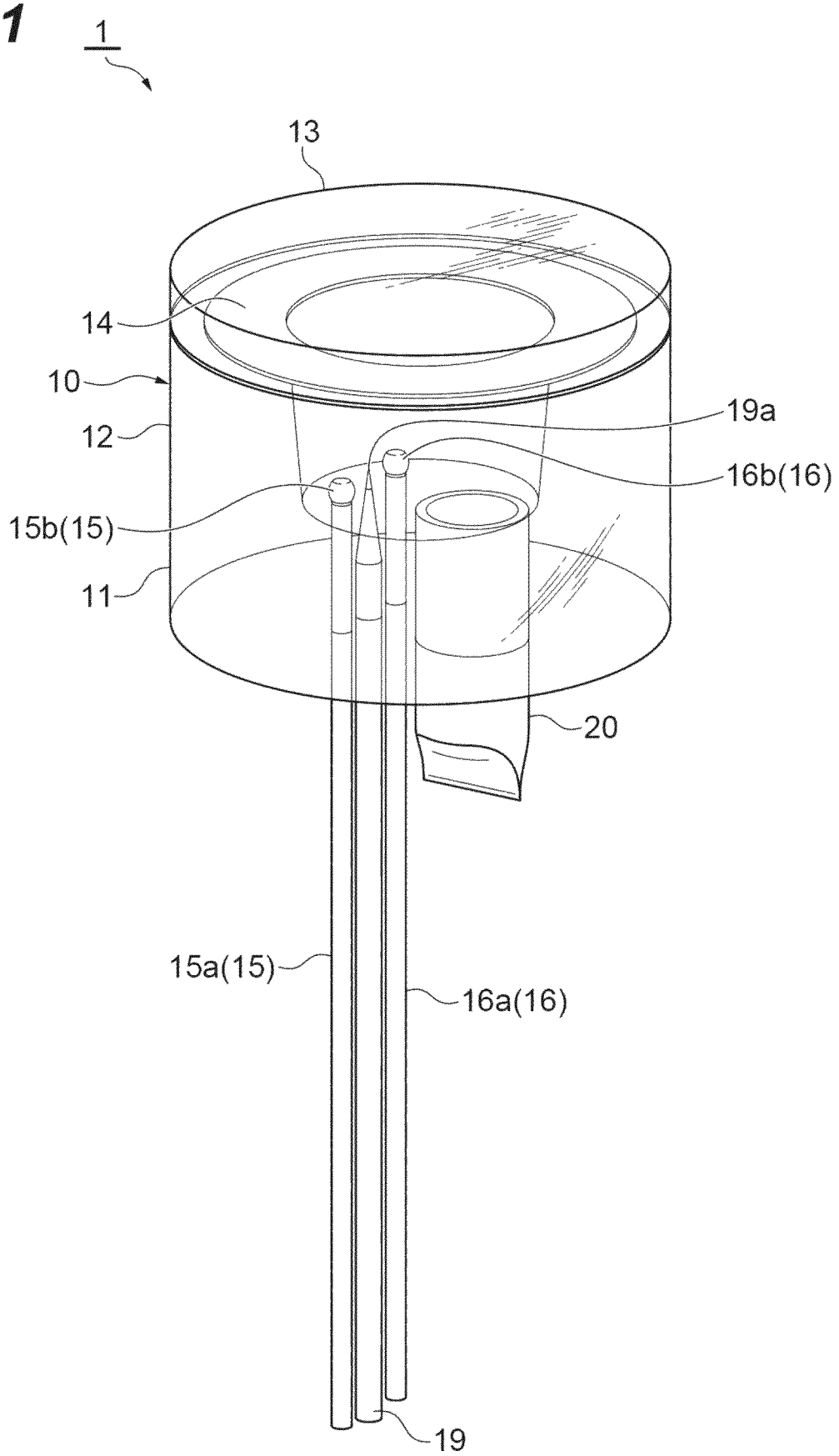
FIG. 1 is a perspective view of a flash lamp according to an embodiment of the present invention.

As shown in FIG. 1, a flash lamp 1 includes a bulb 10 (a housing), conductive linear members 15 and 16 (first and second conductive members), a trigger probe 19 (a third conductive linear member), and an exhaust tube 20. The flash lamp 1 is a lamp that emits a large amount of light in an extremely short time and is, for example, a lamp which is filled with a rare gas as a discharge gas. More specifically, the flash lamp 1 is, for example, a xenon flash lamp which is filled with xenon.

The bulb 10 is an airtight container made of a cylindrical glass member. The bulb 10 includes a stein 11, a side tube 12, a face plate 13, and a frit glass 14. The stein 11, the side tube 12, the frit glass 14, and the face plate 13 are stacked in that order and thus connected to each other to form the bulb 10 in a cylindrical shape. Hereinafter, with regard to a stacking direction of the configuration elements of the bulb 10, a direction from the stein 11 to the face plate 13 may be described as "upward" and a direction from the face plate 13 to the stein 11 may be described as "downward."

Figure 3:
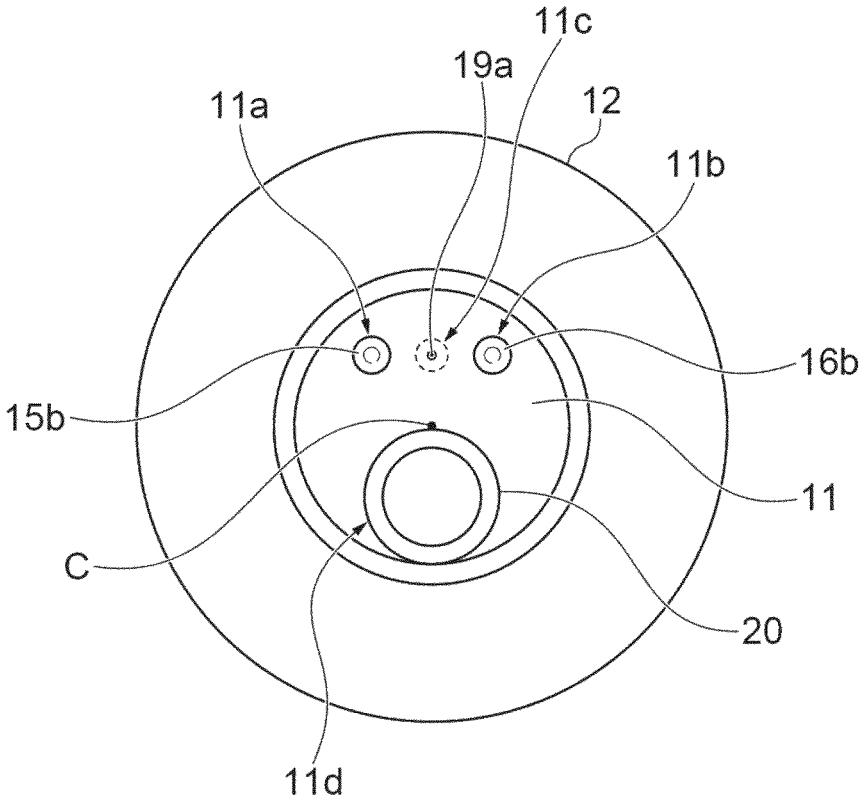
FIG. 3 is a plan view of the flash lamp shown in FIG. 1.
Figure 4:
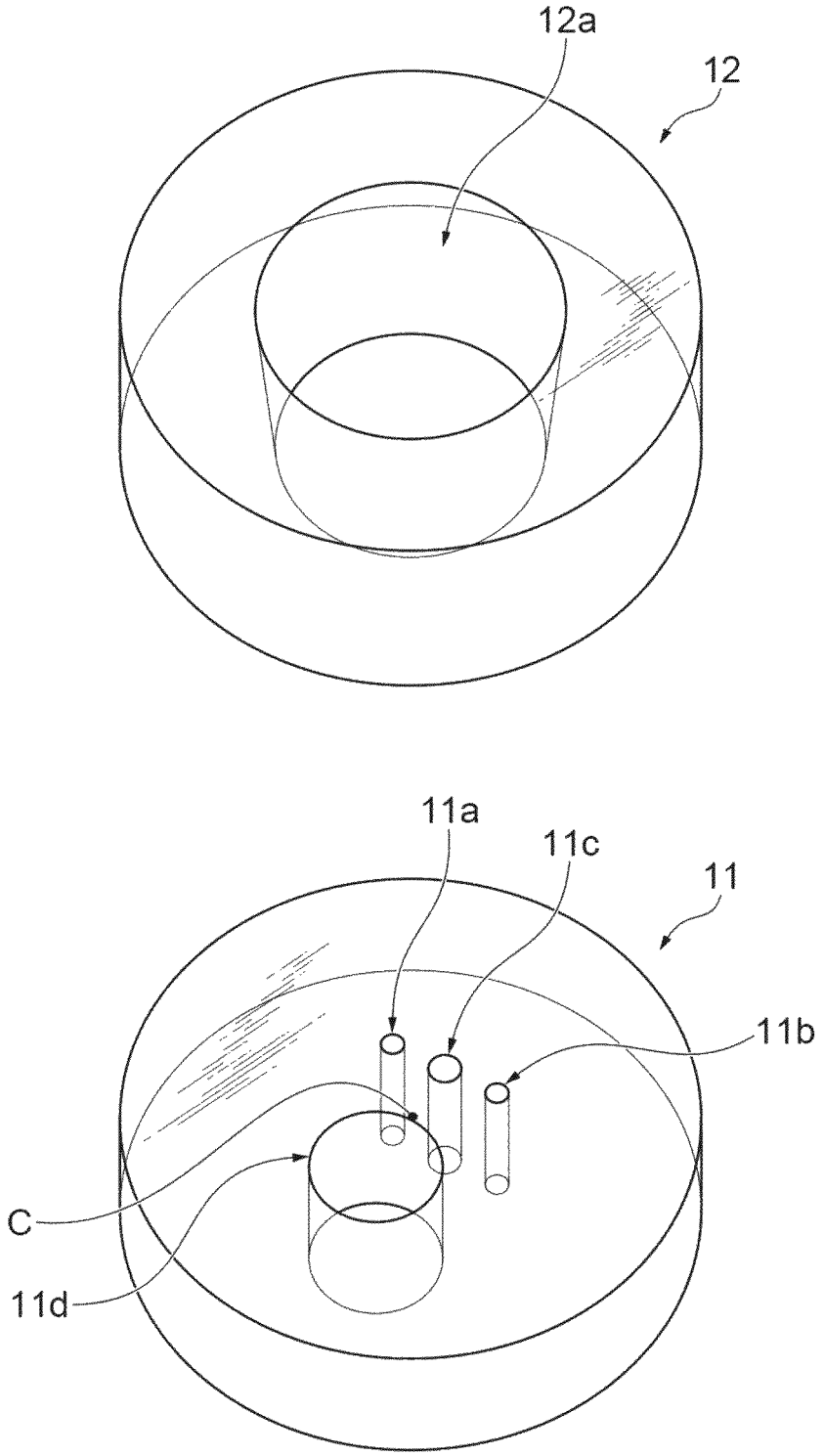
FIG. 4 is a view schematically showing a stein and a side tube.

The stein 11 is a disk-shaped member made of an insulating member such as glass (more specifically, borosilicate glass), for example. The stein 11 has through holes 11*a* to 11*d* penetrating the stein 11 in a thickness direction thereof (see FIG. 4). The through holes 11*a* and 11*b* are through holes into which the conductive linear members 15 and 16 are inserted. The through hole 11*c* is a through hole into which the trigger probe 19 is inserted. The through hole 11*d* is a through hole into which the exhaust tube 20 is inserted. The conductive linear members 15 and 16, the trigger probe 19, and the exhaust tube 20 are inserted into the through holes 11*a* to 11*d* and fixed thereto, and thus the through holes 11*a* to 11*d* are airtightly sealed. The through hole 11*d* has a larger hole diameter than the through holes 11*a* to 11*c*. When seen in the thickness direction of the stein 11 (in a plan view from above or below), the separation distance between a center of the through hole 11*d* and a center of each of the through holes 11*a* and 11*b* is larger than the separation distance between the center of the through hole 11*d* and a center C of the stein 11 (see FIGS. 3 and 4). FIG. 3 is a plan view showing a part of the configuration of the flash lamp 1, and more specifically, is a plan view showing the configuration of the flash lamp 1 excluding the face plate 13 and the frit glass 14. The thickness of the stein 11 is thicker than the thickness of the face plate 13 provided to face the stein (see FIG. 9).

Figure 2:
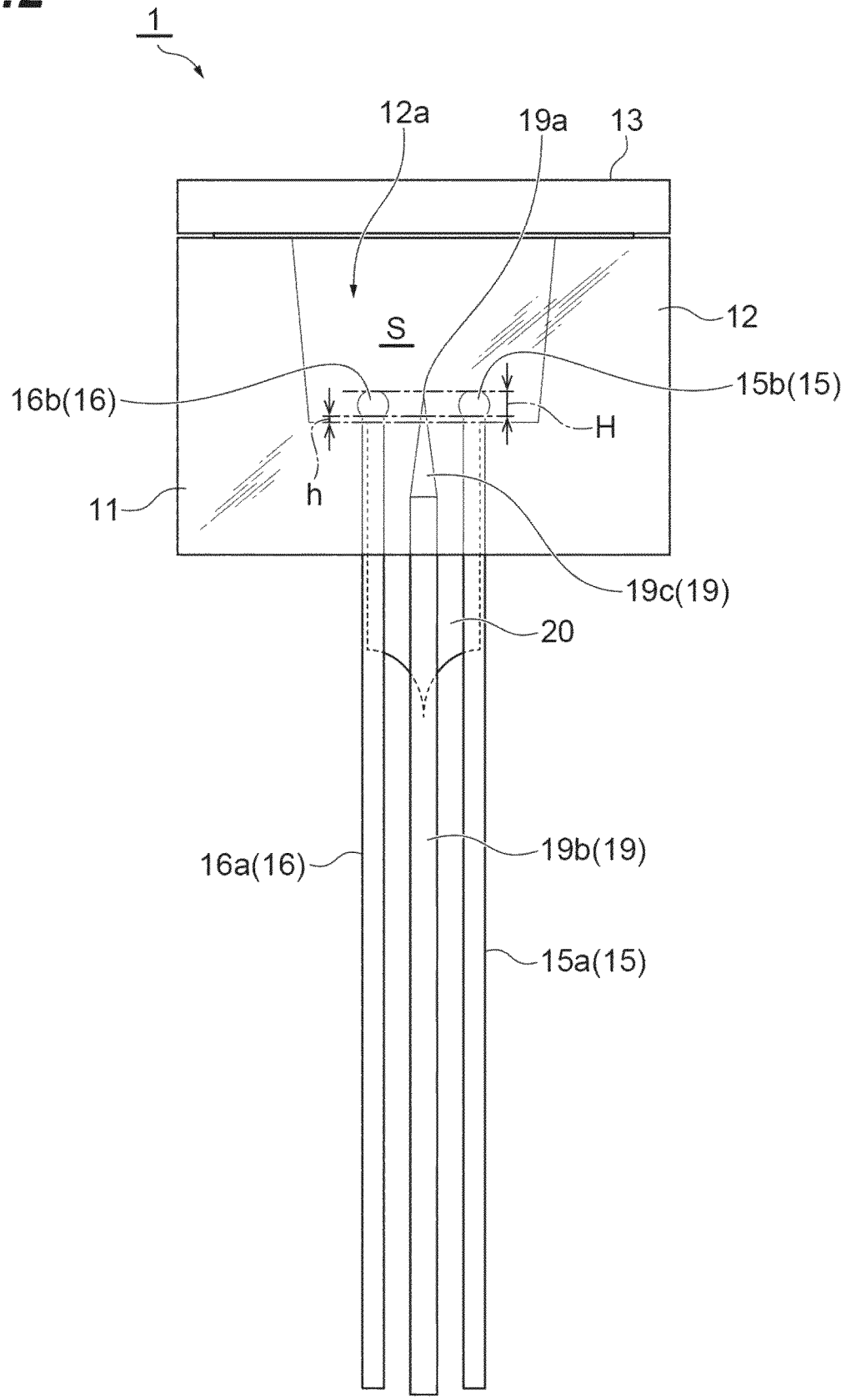
FIG. 2 is a front view of the flash lamp shown in FIG. 1.

The side tube 12 is a disk-shaped member made of an insulating member such as glass (more specifically, borosilicate glass), for example. As shown in FIG. 1, the side tube 12 is stacked on the stein 11 in the thickness direction of the stein 11, and a lower end surface thereof is fused to the stein 11. More specifically, the side tube 12 is fused to an upper surface of the stein 11. The side tube 12 has a through hole 12*a* (see FIG. 4) penetrating the side tube 11 in the thickness direction in a central portion thereof. The through hole 12*a* is formed such that a hole diameter continuously increases (in a tapered shape that continuously shrinks downward) as the distance from the stein 11 increases (as it goes upward). As shown in FIG. 2, the side tube 12 is provided to surround an anode 15*b* (an anode portion) and a cathode 16*b* (a cathode portion) that will be described later. The through hole 12*a* of the side tube 12 is an internal space S which is surrounded by the stein 11, the side tube 12, and the face plate 13 and in which the anode 15*b* and the cathode 16*b* are disposed (see FIG. 2). As described above, since the through hole 12*a* is formed such that the hole diameter increases as it goes upward, the volume of the internal space S increases as it goes upward. Accordingly, when the internal space S is filled with xenon gas from the exhaust tube 20 (details will be described later), the internal space S can be filled with more xenon gas as compared with a container having a vertical inner wall surface, which can contribute to a longer lifespan of the flash lamp 1.

The face plate 13 is a disk-shaped light emitting window provided to face the stein 11. The face plate 13 is made of a light transmitting material such as glass (more specifically, ultraviolet (UV) transmitting glass). The face plate 13 is formed thinner than the stein 11. The face plate 13 is bonded to an upper end surface of the side tube 12 via the frit glass 14. The frit glass 14 is a thin plate-shaped circular member, and a circular hole portion 14*a* (see FIG. 9) is formed in a central portion thereof. The frit glass 14 is sandwiched between the side tube 12 and the face plate 13 such that the hole portion 14*a* corresponds to the through hole 12*a* in the stacking direction, is heated to be melted, and joins the side tube 12 and the face plate 13.

The conductive linear members 15 and 16 are members that extend straightly in a vertical direction to penetrate the stein 11. The conductive linear members 15 and 16 are formed of a conductive material in which a material that easily emits electrons is mixed with a conductive base material. A metal having a high melting point such as molybdenum or tungsten is used as the base material, and one or a plurality of oxides of lanthanum, yttrium, zirconium, barium, scandium, strontium, neodymium, samarium, calcium, hafnium, and the like are used as the material that easily emits electrons. For the conductive linear members 15 and 16, for example, in a case in which glass is used as the stein 11, molybdenum may be used as the base material from the viewpoint of a thermal expansion coefficient, and as a more specific example, lanthanum molybdenum which is an alloy of molybdenum as the base material and lanthanum oxide as the material that easily emits electrons may be used.

The conductive linear member 15 has a lead pin 15*a* (a first lead portion) and the anode 15*b* (the anode portion). The lead pin 15*a* is a member for supporting the anode 15*b* at a desired position in the internal space S and supplying power to the anode 15*b* and extends in the vertical direction to penetrate the stein 11. The lead pin 15*a* is inserted (embedded) into the through hole 11*a* of the stein 11, is fixed to the stein 11, and has both a portion located above the stein 11 and a portion located below the stein 11 (see FIG. 2). The anode 15*b* is positioned in the internal space S when the lead pin 15*a* is fixed to the stein 11.

Figure 5:
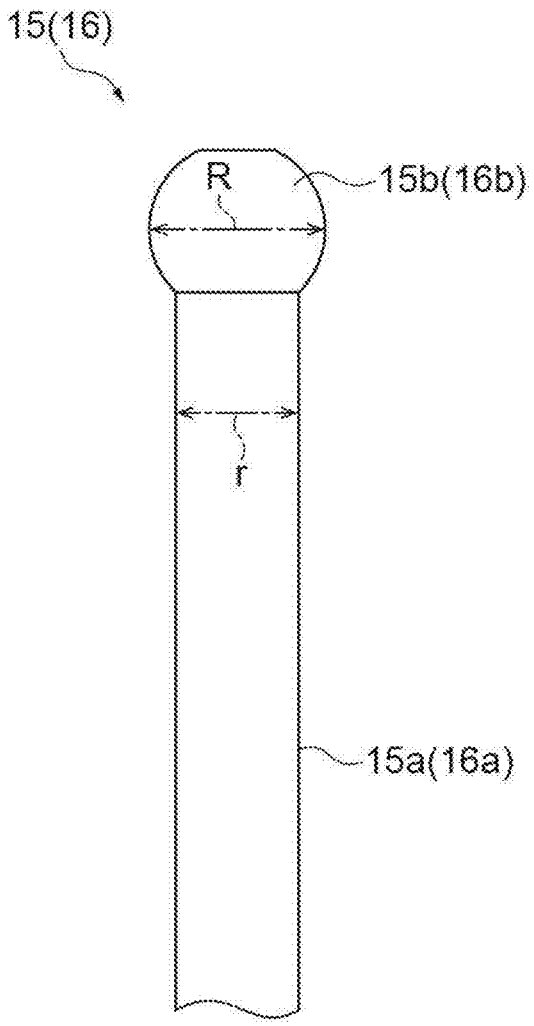
FIG. 5 is a view schematically showing a conductive linear member.

The anode 15*b* is an electrode that protrudes toward the cathode 16*b* on the tip end side (an upper side) of the conductive linear member 15 with respect to the lead pin 15*a* and is housed in the bulb 10. The lead pin 15*a* and the anode 15*b* are integrally formed members. The anode 15*b* has a larger diameter than the lead pin 15*a* (see FIG. 5). Specifically, a diameter R of a large diameter portion of the anode 15*b* may be 1.1 to 3 times or 1.3 to 2 times a diameter r of the lead pin 15*a*. Further, as shown in FIG. 5, the anode 15*b* is formed in a spherical shape. The spherical shape here does not have to be a perfectly spherical shape, and it is sufficient if at least a part of the anode 15*b* (particularly a region protruding toward the cathode 16*b*) has a shape of a part of a sphere (a spherical surface). The anode 15*b* is disposed in the internal space S and is disposed at a position closer to the stein 11 such that a separation distance from the stein 11 is shorter than a separation distance from the face plate 13 (see FIG. 2). As shown in FIG. 2 and the like, in the internal space S which is a space between the face plate 13 and the stein 11, a surface area of the anode 15*b* is larger than a surface area of the lead pin 15*a*. More specifically, as described above, the diameter R of the anode 15*b* is larger than the diameter r of the lead pin 15*a*, a vertical length H of the anode 15*b* is longer than a vertical length h of the lead pin 15*a* (a protruding length above the stein 11), and a ratio of the vertical length H of the anode 15*b* to the vertical length h of the lead pin 15*a* is 1.5 to 20:1 (or 5 to 15:1).

The conductive linear member 16 has a lead pin 16*a* (a second lead portion) and the cathode 16*b* (the cathode portion). The lead pin 16*a* is a member for supporting the cathode 16*b* at a desired position in the internal space S and supplying power to the cathode 16*b* and extends in the vertical direction to penetrate the stein 11. The lead pin 16*a* is inserted (embedded) into the through hole 11*b* of the stein 11, is fixed to the stein 11, and has both a portion located above the stein 11 and a portion located below the stein 11 (see FIG. 2). The cathode 16*b* is positioned in the internal space S when the lead pin 16*a* is fixed to the stein 11. As shown in FIG. 5, a shape of the conductive linear member 16 is the same as a shape of the conductive linear member 15.

The cathode 16*b* is an electrode that protrudes toward the anode 15*b* on the tip end side (an upper side) of the conductive linear member 16 with respect to the lead pin 16*a* and is housed in the bulb 10. The lead pin 16*a* and the cathode 16*b* are integrally formed members. The cathode 16*b* has a larger diameter than the lead pin 16*a* (see FIG. 5). Specifically, a diameter R of a large diameter portion of the cathode 16*b* may be 1.1 to 3 times or 1.3 to 2 times a diameter r of the lead pin 16*a*. Further, as shown in FIG. 5, the cathode 16*b* is formed in a spherical shape. The spherical shape here does not have to be a perfectly spherical shape, and it is sufficient if at least a part of the cathode 16*b* (particularly a region protruding toward the anode 15*b*) has a shape of a part of a sphere (a spherical surface). The cathode 16*b* is disposed in the internal space S and is disposed at a position closer to the stein 11 such that a separation distance from the stein 11 is shorter than a separation distance from the face plate 13 (see FIG. 2). As shown in FIG. 2 and the like, in the internal space S which is a space between the face plate 13 and the stein 11, a surface area of the cathode 16*b* is larger than a surface area of the lead pin 16*a*. More specifically, as described above, the diameter R of the cathode 16*b* is larger than the diameter r of the lead pin 16*a*, a vertical length H of the cathode 16*b* is longer than a vertical length h of the lead pin 16*a* (a protruding length above the stein 11), and a ratio of the vertical length H of the cathode 16*b* to the vertical length h of the lead pin 16*a* is 1.5 to 20:1 (or 5 to 15:1).

The trigger probe 19 is a straight and pointed conductive linear member having a discharging portion 19*a* that controls discharge. The trigger probe 19 is made of, for example, molybdenum. The trigger probe 19 extends in the vertical direction in parallel with the conductive linear members 15 and 16 to penetrate the stein 11 between the conductive linear members 15 and 16. As shown in FIG. 2, the trigger probe 19 has a base portion 19*b* extending in the vertical direction and a tapered portion 19*c* formed in a tapered shape (a conical shape) continuously upward from a tip end (an upper end) of the base portion 19*b*. A tip end (an upper end) of the tapered portion 19*c* is the discharging portion 19*a* that controls the discharge. The discharging portion 19*a* is disposed between the anode 15*b* and the cathode 16*b* in the internal space S, and a tip end of the discharging portion 19*a* is disposed on a line connecting central portions of the anode 15*b* and the cathode 16*b*, or on a side slightly (for example, about 0.1 mm) deviated toward the face plate 13 from the line. As described above, by shortening the lengths of the lead pins 15*a* and 16*a* in the internal space S, and by disposing the tip end of the discharging portion 19*a* which is likely to discharge near the shortest distance portion between the anode 15*b* and the cathode 16*b* separated from the stein 11, it is possible to reliably generate the discharge at the anode 15*b* and the cathode 16*b* (to suppress the generation of the discharge at the lead pins 15*a* and 16*a*). A portion of the tapered portion 19*c* on a base end (a lower end) side is inserted into (embedded in) the through hole 11*c* of the stein 11, and thus the trigger probe 19 is fixed to the stein 11. In this way, by embedding a relatively large diameter portion of the tapered portion 19*c* in the through hole 11*c*, it is possible to reliably fix the trigger probe 19 to the stein 11 and to form the discharging portion 19*a* exposed to the internal space S in an acute-angled shape with a smaller diameter. Further, the base portion 19*b* may have an appropriate thickness for power supply, whereas the discharging portion 19*a* may have the acute-angled shape with a smaller diameter for limiting a discharge region, and thus a lower side of the tapered portion 19*c* may be embedded in the stein 11. In other words, a tapered shape does not start to form from a region included in the internal space S but starts to form from below the upper surface (an inner wall surface) of the stein 11, and thus it is possible to form the region included in the internal space S thin from the beginning and to smoothly form the discharging portion 19*a* in the acute-angled shape with a smaller diameter. Specifically, the tapered shape may start to form from the region embedded in the stein 11. When the flash lamp 1 is miniaturized, the region included in the internal space S is also small (shortened), and thus this structure in which it is possible to form the acute-angled shape with a smaller diameter regardless of the size of the region included in the internal space S is more preferable.

In the flash lamp 1, for example, when a predetermined voltage is applied between the anode 15*b* and the cathode 16*b* via the lead pins 15*a* and 16*a*, and a trigger voltage pulse is applied to the trigger probe 19, discharge is generated in the discharging portion 19*a* of the trigger probe 19, and arc discharge is generated between the anode 15*b* and the cathode 16*b* with this discharge.

The exhaust tube 20 is a metal tubular member for exhausting (evacuating) the internal space S. The exhaust tube 20 is made of, for example, a kovar metal, and an inner diameter of the exhaust tube 20 is larger than at least the diameter of each of the lead pins 15*a* and 16*a* and the trigger probe 19. The exhaust tube 20 extends in the vertical direction to penetrate the stein 11. The exhaust tube 20 shown in FIGS. 1 and 2 is shown in a state in which the exhaust tube 20 is used for exhausting a gas in the internal space S, then is used for filling the internal space S with xenon gas, and then is sealed and cut, however, when used for exhausting a gas and filling the internal space S with xenon gas, the exhaust tube 20 extends further downward (see FIG. 9). The exhaust tube 20 is inserted into (embedded in) the through hole 11*d* (see FIG. 4) of the stein 11 and is fixed to the stein 11. The exhaust tube 20 is disposed substantially flush with the upper surface (the inner wall surface) of the stein 11. As shown in FIG. 3, when seen in the thickness direction of the stein 11 (in a plan from above or below), the separation distance between the exhaust tube 20 and the anode 15*b* is larger than the separation distance between the exhaust tube 20 and the center C of the stein 11, and the separation distance between the exhaust tube 20 from the cathode 16*b* is larger than the separation distance between the exhaust tube 20 and the center C of the stein 11. That is, the exhaust tube 20 is provided in a region opposite to the anode 15*b* and the cathode 16*b* with respect to the center C of the stein 11.

In the flash lamp 1, when the exhaust tube 20 is directly or indirectly connected to a device such as a vacuum pump (not shown), the air in the internal space S is exhausted via the exhaust tube 20. Further, after the exhaust, when the internal space S is filled with the xenon gas via the exhaust tube 20, the flash lamp 1 is in a dischargeable state.

Figure 6:
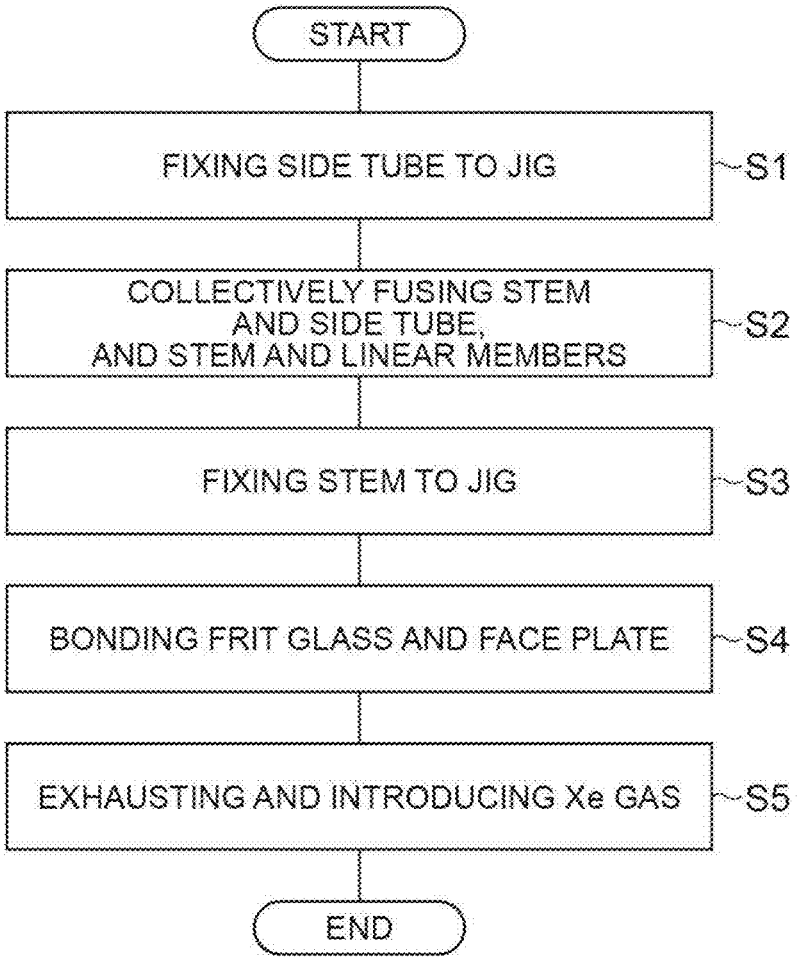
FIG. 6 is a flowchart showing a manufacturing process of the flash lamp.
Figure 7:
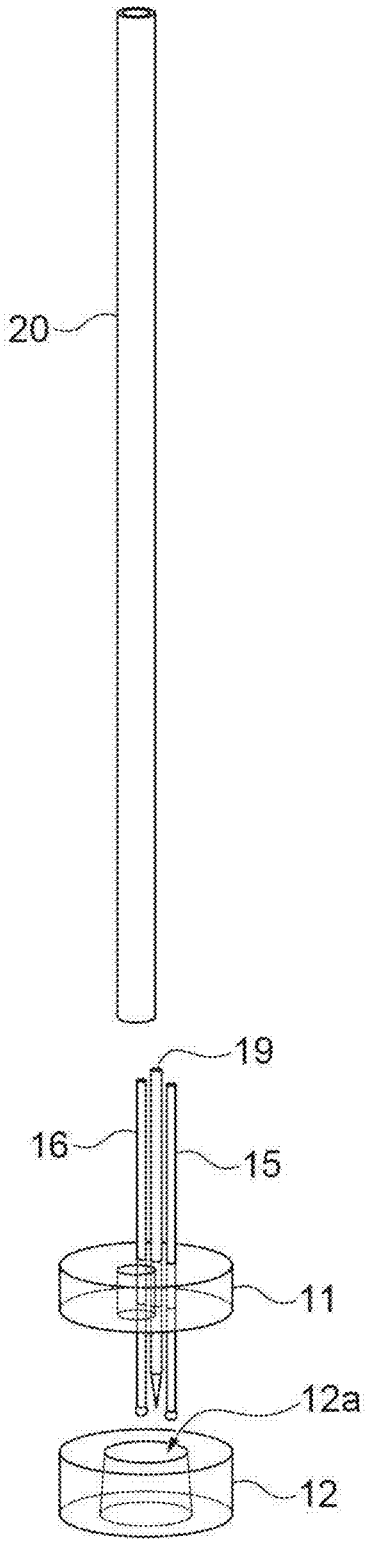
FIG. 7 is a view schematically showing the manufacturing process of the flash lamp.
Figure 8:
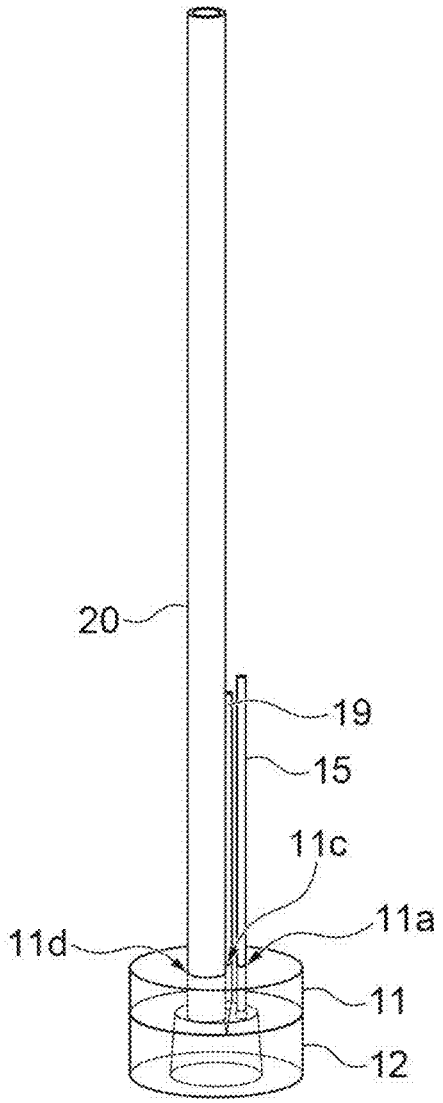
FIG. 8 is a view schematically showing the manufacturing process of the flash lamp.
Figure 9:
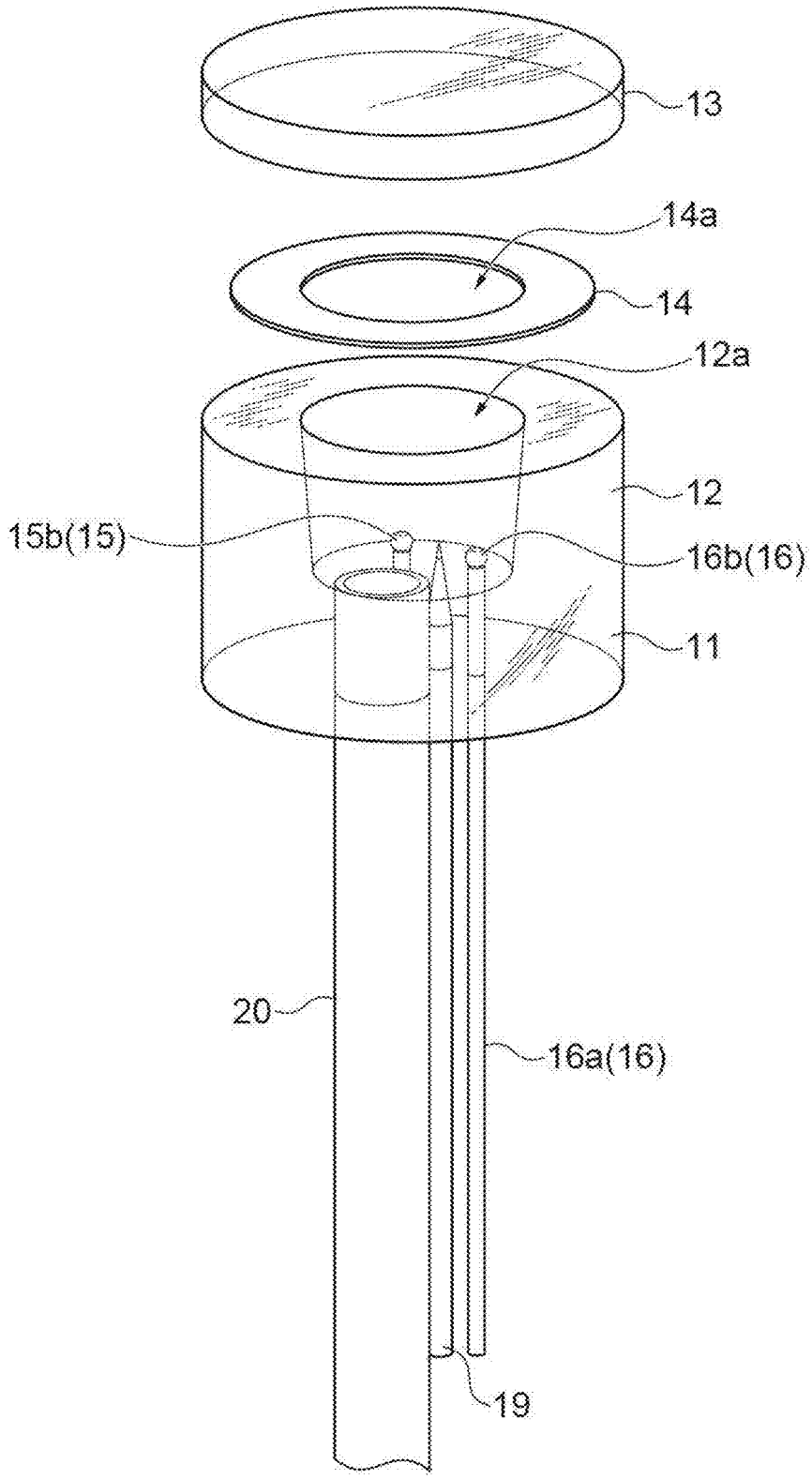
FIG. 9 is a view schematically showing the manufacturing process of the flash lamp.

Next, a manufacturing process of the flash lamp 1 will be described with reference to FIGS. 6 to 9. FIG. 6 is a flowchart showing the manufacturing process of the flash lamp 1. FIGS. 7 to 9 are views schematically showing the manufacturing process of the flash lamp 1.

As shown in FIG. 6, in the manufacturing process of the flash lamp 1, first, the side tube 12 is fixed to a jig (not shown) (step S1). The jig has, for example, a projection. The side tube 12 is disposed with respect to the jig such that the through hole 12*a* of the side tube 12 is fitted to the projection. FIG. 7 shows a state in which the stein 11, the conductive linear members 15 and 16, the trigger probe 19, and the exhaust tube 20 before fusion are brought close to the side tube 12 fixed to the jig (not shown). As shown in FIG. 7, in the side tube 12 fixed to the jig, an end portion on the stein 11 side is disposed on an upper side (upside down), and in a process of connecting the side tube 12 and each member to each other, each member (the stein 11 or the like) to be disposed below the side tube 12 in the flash lamp 1 is brought closer to the side tube 12 from above. In the following, the conductive linear members 15 and 16, the trigger probe 19, and the exhaust tube 20 may be collectively referred to as "linear members."

Subsequently, the stein 11 and the side tube 12, and the stein 11 and the linear members are airtightly and collectively fused (step S2). In a state in which batch fusion is performed, as shown in FIG. 8, the stein 11 is stacked on the side tube 12, the conductive linear members 15 and 16 are inserted into the through holes 11*a* and 11*b* of the stein 11, the trigger probe 19 is inserted into the through hole 11*c*, and the exhaust tube 20 is inserted into the through hole 11*d*. In this state, for example, by performing the batch fusion at a predetermined temperature in an electric furnace, it is possible to perform the connection between the stein 11 and the side tube 12 and the fixing (positioning) of the linear member to the stein 11 at the same time. When the connection between the stein 11 and the side tube 12 is performed, the configuration of an object to which the face plate 13 is connected is a cup-shaped structure in a pre-stage of a second process that will be described later. The above step 1 and step 2 constitute a first process.

Subsequently, the cup-shaped structure in which the stein 11, the side tube 12, and the linear members are fused to each other is fixed to a jig (not shown) different from the jig described above (step S3). Subsequently, as shown in FIG. 9, the frit glass 14 and the face plate 13 are disposed in this order above the side tube 12 (on the upper end surface of the side tube 12), and the face plate 13 is connected to the side tube 12 via the frit glass 14 (step S4). More specifically, when the frit glass 14 sandwiched between the upper end surface of the side tube 12 and the face plate 13 is heated and melted, the side tube 12 and the face plate 13 are connected to each other. The heating and melting are performed, for example, by setting the temperature to a predetermined temperature in an electric furnace. At the time of heating and melting, a weight (not shown) for holding the face plate may be disposed on the upper surface of the face plate. In this way, by connecting the cup-shaped structure in which the stein 11 and the side tube 12 are connected to each other and the face plate 13 to each other by the frit glass 14, it is possible to perform a work of manufacturing a pre-exhaust structure in which the cup-shaped structure is airtightly covered by batch processing.

Subsequently, the exhaust tube 20 protruding from the stein 11 of the pre-exhaust structure is attached to an exhaust stand (mechanical equipment), the internal space S is evacuated via the exhaust tube 20 by a vacuum pump or the like, and then the internal space S is filled with the xenon gas via the exhaust tube 20 (step S5). Finally, the exhaust tube 20 is sealed, the excess portion is cut off, the internal space S is sealed, and the flash lamp 1 is manufactured.

Next, the operation and effect of the flash lamp 1 and the manufacturing method for the flash lamp 1 according to the present embodiment will be described.

As described above, the flash lamp 1 includes the bulb 10 including the stein 11, the conductive linear members 15 and 16 extending to penetrate the stein 11, and the trigger probe 19 having the discharging portion 19*a* configured to control discharge, the conductive linear member 15 has the lead pin 15*a* and the anode 15*b* protruding toward the conductive linear member 16 on the tip end side of the conductive linear member 15 with respect to the lead pin 15*a* and housed in the bulb 10, the lead pin 15*a* and the anode 15*b* are integrally formed members, the conductive linear member 16 has the lead pin 16*a* and the cathode 16*b* protruding toward the conductive linear member 15 on the tip end side of the conductive linear member 16 with respect to the lead pin 16*a* and housed in the bulb 10, the lead pin 16*a* and the cathode 16*b* are integrally formed members, and the discharging portion 19*a* of the trigger probe 19 is disposed between the anode 15*b* and the cathode 16*b*.

In the flash lamp 1 according to the present embodiment, the lead pin 15*a* and the anode 15*b* of the conductive linear member 15 are integrally formed members, and the lead pin 16*a* and the cathode 16*b* of the conductive linear member 16 are integrally formed members. Accordingly, it is unnecessary to fix the anode 15*b* and the cathode 16*b* to the lead pin 15*a* and the lead pin 16*a*. Therefore, by simply fixing (installing) the conductive linear members 15 and 16, more specifically, the lead pin 15*a* and the lead pin 16*a* to the stein 11 appropriately, it is possible to complete the positioning of the anode 15*b* and the cathode 16*b* in the flash lamp 1 with high accuracy. Therefore, it is possible to easily manufacture the flash lamp 1 having uniform light emission characteristics without man-hours. Thus, it is possible to realize the reduction of the manufacturing cost of the flash lamp 1. Further, by using a member in which the lead pin and the electrode are integrally formed (a member for which welding or the like of the electrode is unnecessary after the lead pin is installed), the manufacturing easiness can be ensured even in the miniaturized flash lamp 1.

Further, the anode 15*b* has a larger diameter than the lead pin 15*a* and the cathode 16*b* has a larger diameter than the lead pin 16*a*. By increasing the diameters of the anode 15*b* and the cathode 16*b*, it is possible to cause the discharge between the conductive linear members 15 and 16 to be reliably performed between the anode 15*b* and the cathode 16*b*. That is, for example, a light emitting point is prevented from becoming non-uniform due to the discharge between the conductive linear members 15 and 16 occurring at the electrodes (the anode 15*b* and the cathode 16*b*), or in a region other than the electrodes, and thus more uniform light emission characteristics can be obtained.

Further, the anode 15*b* and the cathode 16*b* are formed in a spherical shape. By forming the anode 15*b* and the cathode 16*b* in a spherical shape, it is possible for the anode 15*b* and the cathode 16*b* to face each other in a desired state regardless of the protruding orientations of the anode 15*b* and the cathode 16*b* when the conductive linear members 15 and 16 are fixed to the stein 11, and it is possible to more easily manufacture the flash lamp 1 having uniform light emission characteristics. That is, for example, in a case in which the anode and the cathode are formed in a substantially bullet-shape as in the related art, it is necessary to specify the orientations of the conductive linear members and to fix the conductive linear members to the stein such that the tips of the anode and the cathode face each other, however in a case in which the anode and the cathode are formed in a spherical shape, the facing state between the anode 15*b* and the cathode 16*b* does not change regardless of the orientations in which the conductive linear members 15 and 16 are rotated along their axes, and thus it is possible to fix the conductive linear members 15 and 16 to the stein 11 without specifying the orientations of the conductive linear members 15 and 16. Further, by forming the anode 15*b* and the cathode 16*b* in a spherical shape, it is easy to specify a discharge path in a region including a point at which the distance between the anode 15*b* and the cathode 16*b* is shortest (the distance is closest), and for example, compared with a case in which the region in which the anode and the cathode face each other is a surface, it is possible to suppress the movement of the light emitting point and to obtain more uniform light emitting characteristics.

Further, the trigger probe 19 may be made of a straight conductive linear member extending to penetrate the stein 11 between the conductive linear members 15 and 16. Accordingly, simply by adjusting the height (the protruding length) of the trigger probe 19 in the internal space S, it is easy to accurately dispose the discharging portion 19*a* of the trigger probe 19 between the anode 15*b* and the cathode 16*b*. Further, for example, unlike a case in which the trigger probe is welded to the conductive linear members, it is possible to perform an operation that the trigger probe 19 and the conductive linear members 15 and 16 can be installed at the same time or the like, and thus manufacturing becomes easier. Further, it is possible to make a configuration stronger against shaking and the like, compared with the configuration in which the trigger probe is welded to the conductive linear member or the configuration in which the trigger probe penetrates the stein 11 at a position away from the conductive linear members 15 and 16 and bends in the middle to position the discharging portion between the anode 15*b* and the cathode 16*b*.

Further, the bulb 10 includes the face plate 13 which is a light emitting window provided to face the stein 11, and the anode 15*b* and the cathode 16*b* are disposed such that a separation distance from the stein 11 is shorter than a separation distance from the face plate 13. In this way, by providing the anode 15*b* and the cathode 16*b* at positions closer to the stein 11, it is possible to reduce a region exposed in a space between the stein 11 and the face plate 13 in the lead pin 15*a* and the lead pin 16*a* supporting the anode 15*b* and the cathode 16*b* (a region exposed to the internal space S inside the bulb 10). Accordingly, it is possible to cause the discharge between the conductive linear members 15 and 16 to be reliably performed between the anode 15*b* and the cathode 16*b*. Therefore, more uniform light emission characteristics can be obtained.

Further, in the internal space S, the surface area of the anode 15*b* is larger than the surface area of the lead pin 15*a*, and the surface area of the cathode 16*b* is larger than the surface area of the lead pin 16*a*. Accordingly, the region occupied by the electrodes (the anode 15*b* and the cathode 16*b*) of the conductive linear members 15 and 16 exposed in the internal space S which is the space between the stein 11 and the face plate 13 can be larger than the region occupied by the lead pin 15*a* and the lead pin 16*a*, and the discharge between the conductive linear members 15 and 16 can be reliably performed between the anode 15*b* and the cathode 16*b*. Therefore, more uniform light emission characteristics can be obtained, and discharge can be appropriately performed in the intended region (the anode 15*b* and the cathode 16*b*).

Further, the bulb 10 includes the face plate 13 which is a light emitting window provided to face the stein 11, and a thickness of the stein 11 is thicker than a thickness of the face plate 13. Accordingly, the conductive linear members 15 and 16 penetrating the stein 11 can be easily fixed to the stein 11 while the light transmission of the face plate 13 is improved, and the positional accuracy of the anode 15*b* and the cathode 16*b* can be improved.

Furthermore, the flash lamp 1 may further include the exhaust tube 20 for exhausting the inside of the bulb 10, the exhaust tube 20 may extend to penetrate the stein 11, and, when seen in the thickness direction of the stein 11, the exhaust tube 20 may be provided in a region opposite to the conductive linear members 15 and 16 with respect to the center of the stein 11. In other words, the separation distance between the exhaust tube 20 and the anode 15*b* is larger than the separation distance between the exhaust tube 20 and the center C of the stein 11, and the separation distance between the exhaust tube 20 from the cathode 16*b* is larger than the separation distance between the exhaust tube 20 and the center C of the stein 11. In this way, by providing the exhaust tube 20 in the region opposite to the electrodes (the anode 15*b* and the cathode 16*b*) with respect to the center C of the stein 11, it is possible to increase the opening area of the exhaust tube 20, and it is possible to efficiently exhaust the inside of the bulb 10. Accordingly, the flash lamp 1 can be efficiently manufactured. Further, in a case in which the exhaust tube 20 is made of a metal, the discharge may occur between the exhaust tube 20, the anode 15*b*, and the cathode 16*b*, but the exhaust tube 20, the anode 15*b*, and the cathode 16*b* are provided to be separated from each other, and thus the discharge can be suppressed. Since the through hole 11*d* of the stein 11 formed for providing the exhaust tube 20 has a larger diameter than the other through holes, dents and ridges may occur in the peripheral region of the exhaust tube 20 in the stein 11 due to the influence of heating when the exhaust tube 20 is fixed, however by providing the anode 15*b* and the cathode 16*b* deviating from such a region, it is possible to fix the anode 15*b* and the cathode 16*b* in a stable state.

As described above, the manufacturing method for the flash lamp 1 according to the present embodiment includes the first process of fixing the conductive linear members 15 and 16 to the stein 11 constituting the bulb 10 and connected to the side tube 12 provided to surround the anode 15*b* and the cathode 16*b*, and the second process of bonding the face plate 13 which is a light emitting window provided to face the stein 11 to the side tube 12 after the first process. According to such a manufacturing method, the conductive linear members 15 and 16 can be fixed to the stein 11 before the face plate 13 or the like is provided. Therefore, the face plate 13 can be fixed in a state in which the anode 15*b* and the cathode 16*b* are surrounded by the side tube 12, and thus a problem of the face plate 13 coining into contact with the anode 15*b* and the cathode 16*b* during the fixing work of the face plate can be suppressed.

In the first process described above, the fixing of the conductive linear members 15 and 16 to the stein 11 and the connection of the stein 11 to the side tube 12 are collectively performed. For example, in a case in which the side tube 12 is fused to the stein 11 after the conductive linear members 15 and 16 are fixed to the stein 11, when the side tube 12 is fused to the stein 11, the positions of the conductive linear members 15 and 16 (the fixed state of the conductive linear members 15 and 16) in the stein 11 may be affected. In this respect, by collectively perform the fixing of the conductive linear members 15 and 16 to the stein 11 and the connection of the stein 11 to the side tube 12, it is possible to suppress the influence on the positions of the conductive linear members 15 and 16 as described above. Such a batch fusion is possible because the lead pin and the electrode are integrally formed members and are easy to handle as in the flash lamp 1 of the present embodiment.

In the first process described above, in a state in which the side tube 12 and the stein 11 are disposed with respect to the jig having the projection for the through hole 12*a* of the side tube 12 to be fitted onto with the stein 11 facing the projection, the conductive linear members 15 and 16 are fixed to the stein 11. In this way, the side tube 12 is fitted and fixed (positioned) to the projection, and the first process is performed, and thus the first process can be performed more easily and with high accuracy. Further, by bringing the projection of the jig into contact with the stein 11 and the side tube 12 in a heating environment, it is possible to suppress deformation and surface roughness of the inner wall surfaces of the stein 11 and the side tube 12 and to obtain a desired shape and a desired surface state.

Figure 10:
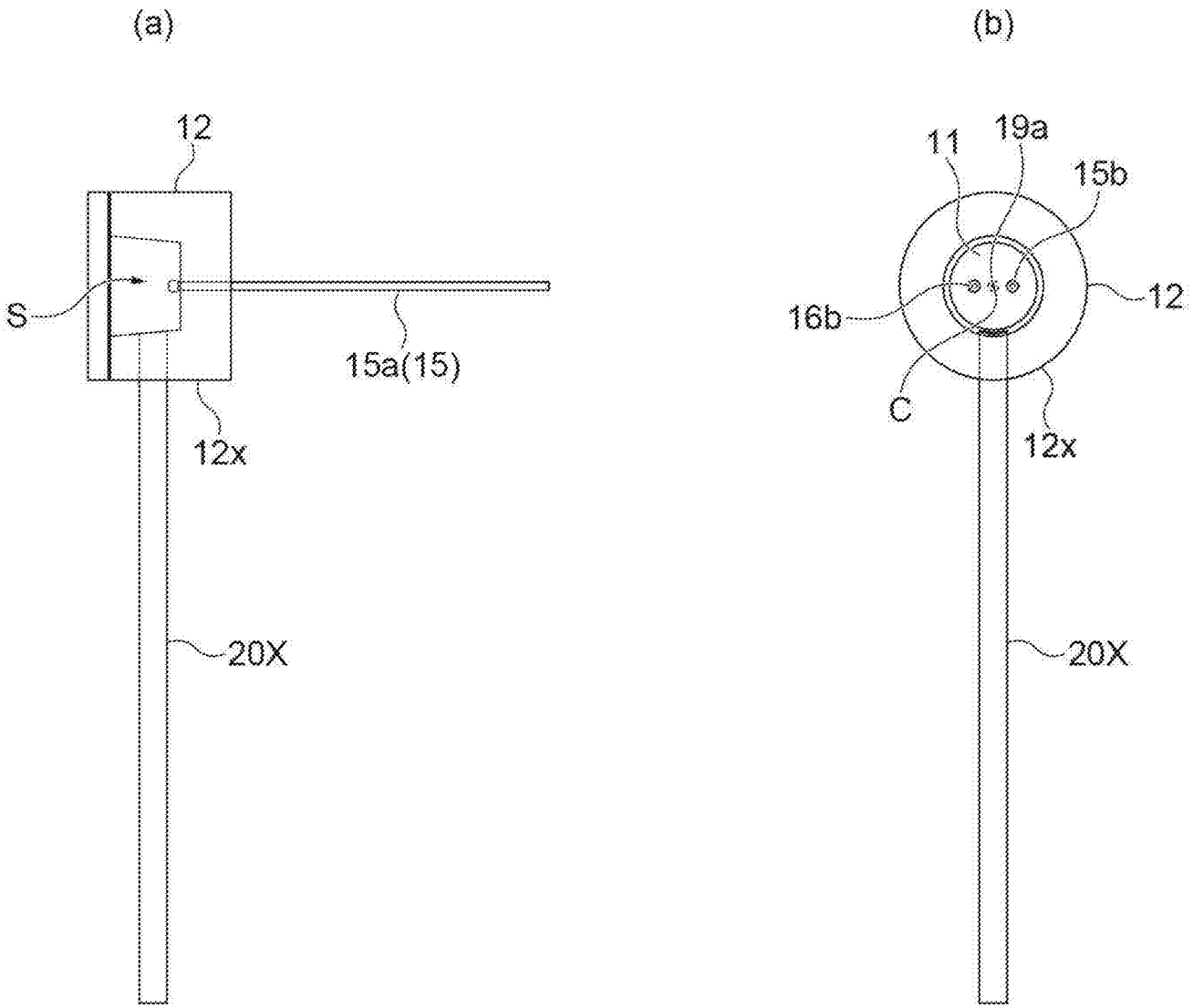
FIG. 10 is a view schematically showing a flash lamp according to a modification example, FIG. 10(*a*) is a side view, and FIG. 10(*b*) is a plan view.

Although the present embodiment has been described above, the present invention is not limited to the above embodiment. For example, the exhaust tube 20 has been described as extending in the vertical direction to penetrate the stein 11, but the present invention is not limited to this, and as shown in FIGS. 10(*a*) and 10(*b*), an exhaust tube 20X may extend from a side surface 12*x* of the side tube 12 toward the internal space S. In such a configuration, since the anode 15*b* and the cathode 16*b* can be disposed on the stein 11 without considering the disposition of the exhaust tube 20, the anode 15*b* and the cathode 16*b* can be disposed at positions close to the center C of the stein 11 as shown in FIG. 10(*b*). That is, the light emitting point can be provided at the center of the flash lamp 1, and the position of the light emitting point can be easily determined.

Further, in the description of the manufacturing process, the stein 11 and the conductive linear members 15 and 16, and the stein 11 and the side tube 12 have been described as being collectively fused, but the present invention is not limited to this, and for example, the conductive linear member may be fixed to the stein integrally formed with the side tube in advance. That is, in the description of the manufacturing process, the configuration of the object to which the face plate 13 is bonded has been described as being a cup-shaped structure in which the stein 11 and the side tube 12 are bonded to each other, but the present invention is not limited to this, and a member having a button stein shape may be used as an insulating member. In this way, by creating the shape in which the stein and the side tube are connected to each other from the beginning, it is possible to suppress the influence of the connection process between the stein and the side tube on the positions of the conductive linear members. Further, the stein 11 and the side tube 12 are made of an insulating material such as glass, but they may be made of a metal material. In this case, at least the conductive linear members 15 and 16 and the trigger probe 19 are fixed to the stein 11 via the insulating member. Further, the exhaust tube 20 may be made of an insulating member such as glass, for example, instead of a metal. Further, in the connection between the side tube 12 and the face plate 13, direct fusion may be performed without using the frit glass 14.

REFERENCE SIGNS LIST

1 Flash lamp
10 Bulb (housing)
11 Stein
12 Side tube
13 Face plate
15, 16 Conductive linear members (first and second conductive linear members)
15*a* Lead pin (first lead portion)
15*b* Anode (anode portion)
16*a* Lead pin (second lead portion)
16*b* Cathode (cathode portion)
19 Trigger probe (third conductive linear member)
19*a* Discharging portion
20, 20X Exhaust tube

The invention claimed is:

1. A flash lamp comprising:
a housing including a stem; and
first and second conductive linear members extending to penetrate the stem;
wherein the first conductive linear member has a first lead portion and an anode portion protruding toward the second conductive linear member on a tip end side of the first conductive linear member with respect to the first lead portion and housed in the housing,
wherein the first lead portion and the anode portion are integrally formed members,
wherein the second conductive linear member has a second lead portion and a cathode portion protruding toward the first conductive linear member on a tip end side of the second conductive linear member with respect to the second lead portion and housed in the housing,
wherein the second lead portion and the cathode portion are integrally formed members,
wherein the anode portion has a larger diameter than the first lead portion,
wherein the cathode portion has a larger diameter than the second lead portion, and
wherein the anode portion and the cathode portion are formed in a spherical shape.

2. The flash lamp according to claim 1, further comprising:
a trigger probe having a discharging portion configured to control discharge,
wherein the discharging portion of the trigger probe is disposed between the anode portion and the cathode portion, and
wherein the trigger probe is made of a straight third conductive linear member extending to penetrate the stem between the first and second conductive linear members.

3. The flash lamp according to claim 1,
wherein the housing includes a face plate which is a light emitting window provided to face the stem, and
wherein the anode portion and the cathode portion are disposed such that a separation distance from the stem is shorter than a separation distance from the face plate.

4. The flash lamp according to claim 3, wherein, in a space between the face plate and the stem, a surface area of the anode portion is larger than a surface area of the first lead portion, and a surface area of the cathode portion is larger than a surface area of the second lead portion.

5. The flash lamp according to claim 1,
wherein the housing includes a face plate which is a light emitting window provided to face the stem, and
wherein a thickness of the stem is thicker than a thickness of the face plate.

6. The flash lamp according to claim 1, further comprising an exhaust tube for exhausting an inside of the housing,
wherein the exhaust tube extends to penetrate the stem, and
wherein, when seen in a thickness direction of the stem, the exhaust tube is provided in a region opposite to the first and second conductive linear members with respect to a center of the stem.

7. A manufacturing method for a flash lamp which is the flash lamp according to claim 1, comprising:
a first process of fixing the first and second conductive linear members to the stem constituting the housing and connected to a side tube provided to surround the anode portion and the cathode portion; and
a second process of connecting the face plate which is a light emitting window provided to face the stem to the side tube after the first process.

8. The manufacturing method for a flash lamp according to claim 7, wherein, in the first process, the fixing of the first and second conductive linear members to the stem and the connection of the stem to the side tube are collectively performed.

9. The manufacturing method for a flash lamp according to claim 7, wherein, in the first process, the first and second conductive linear members are fixed to the stem integrally formed with the side tube in advance.

10. The manufacturing method for a flash lamp according to claim 7, wherein, in the first process, in a state in which the side tube and the stem are disposed with respect to a jig having a projection for a through hole of the side tube to be fitted onto with the stem facing the projection, the first and second conductive linear members are fixed to the stem.

* * * * *